US008109026B1

(12) United States Patent
Bentley et al.

(10) Patent No.: US 8,109,026 B1
(45) Date of Patent: Feb. 7, 2012

(54) FOLDING GUNSTOCK

(75) Inventors: James K. Bentley, Paso Robles, CA (US); Thomas M. Gregory, Belgrade, MT (US); Robert A. Kincaid, Bozeman, MT (US); Birten L. Todd, Harrison, MT (US)

(73) Assignee: Alliant Techsystems Inc., Minneapolis, MN (US)

( * ) Notice: Subject to any disclaimer, the term of this patent is extended or adjusted under 35 U.S.C. 154(b) by 64 days.

(21) Appl. No.: 12/660,632

(22) Filed: Mar. 2, 2010

Related U.S. Application Data

(63) Continuation-in-part of application No. 11/704,023, filed on Feb. 8, 2007, now Pat. No. 7,698,848.

(60) Provisional application No. 60/771,754, filed on Feb. 8, 2006.

(51) Int. Cl.
*F41C 23/14* (2006.01)

(52) U.S. Cl. ..... 42/73

(58) Field of Classification Search ..... 42/71.01–74
See application file for complete search history.

(56) References Cited

U.S. PATENT DOCUMENTS

| | | | | | |
|---|---|---|---|---|---|
| 1,016,695 | A | * | 2/1912 | Kimmel | 42/72 |
| 1,315,215 | A | * | 9/1919 | Davidson | 42/72 |
| 1,477,445 | A | * | 12/1923 | Petritsch | 42/72 |
| 2,424,194 | A | * | 7/1947 | Sampson et al. | 42/72 |
| 2,466,017 | A | * | 4/1949 | Farber | 42/72 |
| 3,201,887 | A | * | 8/1965 | Sedelow | 42/72 |
| 3,256,632 | A | * | 6/1966 | Beretta | 42/72 |
| 3,269,380 | A | * | 8/1966 | Stevens | 124/25 |
| 3,570,162 | A | * | 3/1971 | Suddarth | 42/72 |
| 3,648,396 | A | * | 3/1972 | Smith | 42/94 |
| 3,782,019 | A | * | 1/1974 | Venturini | 42/72 |
| 4,291,482 | A | * | 9/1981 | Bresan | 42/72 |
| 4,788,785 | A | * | 12/1988 | White | 42/72 |
| 6,560,911 | B2 | * | 5/2003 | Sharp | 42/73 |

* cited by examiner

*Primary Examiner* — Troy Chambers
(74) *Attorney, Agent, or Firm* — Wooten & Shaddock, PLC

(57) ABSTRACT

A folding stock assembly for firearms such as rifles and shotguns. The stock is made of metal rod that has been bent to form laterally spaced left and right elongated arm members that have rear ends connected to the top end of a U-shaped shoulder rest portion. The front end of the respective elongated arm members are pivotally connected to the rear end of a neck portion extending rearwardly from the upper end of the handgrip. There is structure in the interior of the end cap for locking the elongated arm members in either its static storage position or its rearward functional deployed position.

11 Claims, 8 Drawing Sheets

FOLDING GUNSTOCK

CROSS-REFERENCE TO RELATED APPLICATIONS

This is a Continuation-In-Part of U.S. patent application Ser. No. 11/704,023, filed Feb. 8, 2007, now U.S. Pat. No. 7,698,848, which claims priority from U.S. Provisional Patent Application Ser. No. 60/771,754 filed Feb. 8, 2006.

BACKGROUND OF THE INVENTION

1. Field of the Invention

The present invention is directed generally to a folding stock assembly. More specifically, the present invention is directed to a folding stock assembly that can be mounted on the rearwardly extending neck portion of a handgrip for a firearm.

SUMMARY OF THE INVENTION

In various exemplary embodiments, the primary components of the folding stock assembly are the elongated stock, the structure for controlling rotation of the stock from a stored position to a deployed position, and structure for securing the stock to the rear end of the neck portion of a handgrip. The elongated stock is preferably made of metal rod that is bent to form laterally spaced elongated left and right arm members each having a front end and a rear end. The metal rod is also bent to form a U-shaped shoulder rest portion whose top ends are connected to the rear ends of the respective elongated arm members. There is sufficient springiness to the metal rod that allows the front ends of the elongated arm members to be squeezed together for a purpose to be discussed later. The elongated stock could also be made of a proper plastic material.

There are front end members connected to the front ends of the respective elongated arm members. Extending inwardly from the respective front end members is a left shaft and a right shaft. A left disc is secured to the left shaft and the right disc is secured to the right shaft. There are diametrically opposed secondary apertures formed in the rear end of the tubular portion at the rear end of the neck portion of the handgrip. There are diametrically opposed primary apertures in the end cap that telescopes over the tubular rear end of the neck portion. The left and right shafts are inserted into the respective primary and secondary apertures prior to the left and right discs being installed on the inner ends of the respective shafts. The respective discs are tightened onto the shafts by set screws that can be reached by an Allen wrench inserted through the open front end of tubular member on the rear end of the neck portion of the handgrip.

Accordingly, this invention provides a folding stock assembly having novel structure for limiting both forward and rearward rotation.

This invention separately provides a folding stock assembly having novel structure for locking it in its static forward stored position and also locking it in its rearward functional deployed position.

This invention separately provides a folding stock assembly having a novel structure for securing it to a rearwardly extending neck portion formed adjacent the top end of a handgrip.

This invention separately provides a folding stock assembly that is economical to manufacture and market.

This invention separately provides a folding stock assembly that is easily installed.

These and other features and advantages of this invention are described in or are apparent from the following detailed description of the exemplary, non-limiting embodiments.

DESCRIPTION OF THE DRAWINGS

The exemplary embodiments of this invention will be described in detail, with reference to the following figures, wherein like reference numerals refer to like parts throughout the several views, and wherein.

DESCRIPTION OF THE PREFERRED EMBODIMENT

For simplicity and clarification, the design factors and operating principles of the folding stock according to this invention are explained with reference to various exemplary embodiments of a folding stock according to this invention. The basic explanation of the design factors and operating principles of the folding stock is applicable for the understanding, design, and operation of the folding stock of this invention.

It should also be appreciated that the terms "firearm", "rifle", and "shotgun" are used for basic explanation and understanding of the operation of the systems, methods, and apparatuses of this invention. Therefore, the terms "firearm", "rifle", and "shotgun" are not to be construed as limiting the systems, methods, and apparatuses of this invention.

Figure 1:
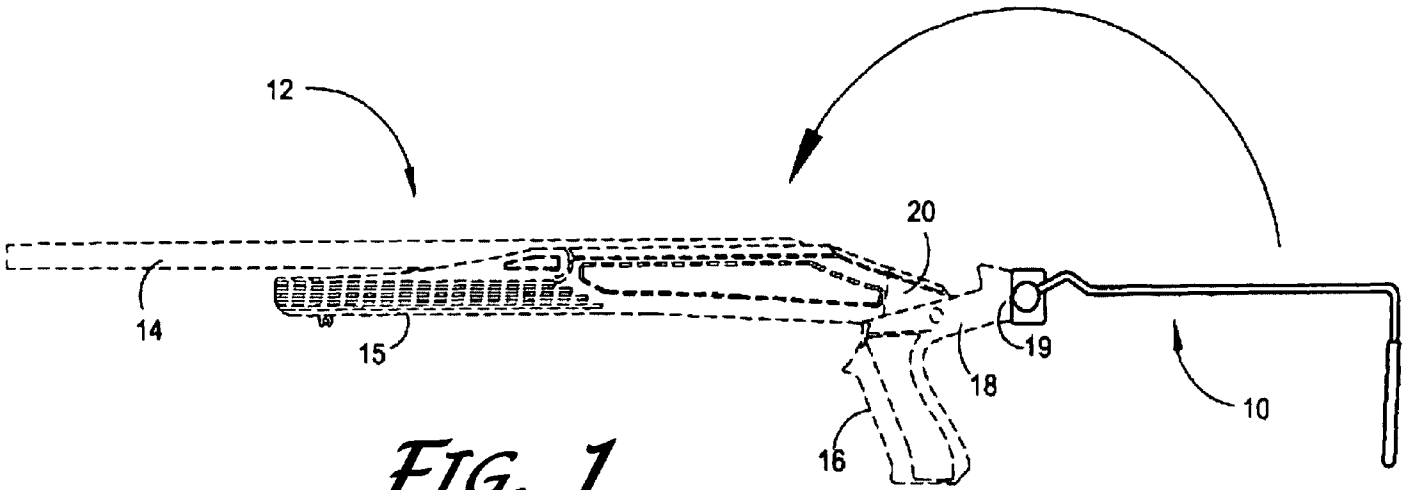
FIG. 1 illustrates an exemplary firearm with the elongated stock in its rearward functional deployed position.
Figure 2:
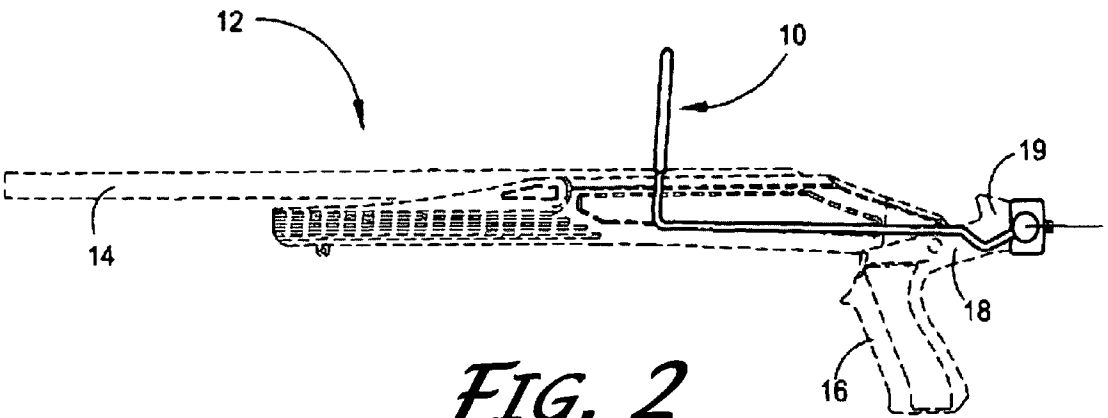
FIG. 2 illustrates the elongated stock pivoted forward to its static forward stored position.
Figure 3:
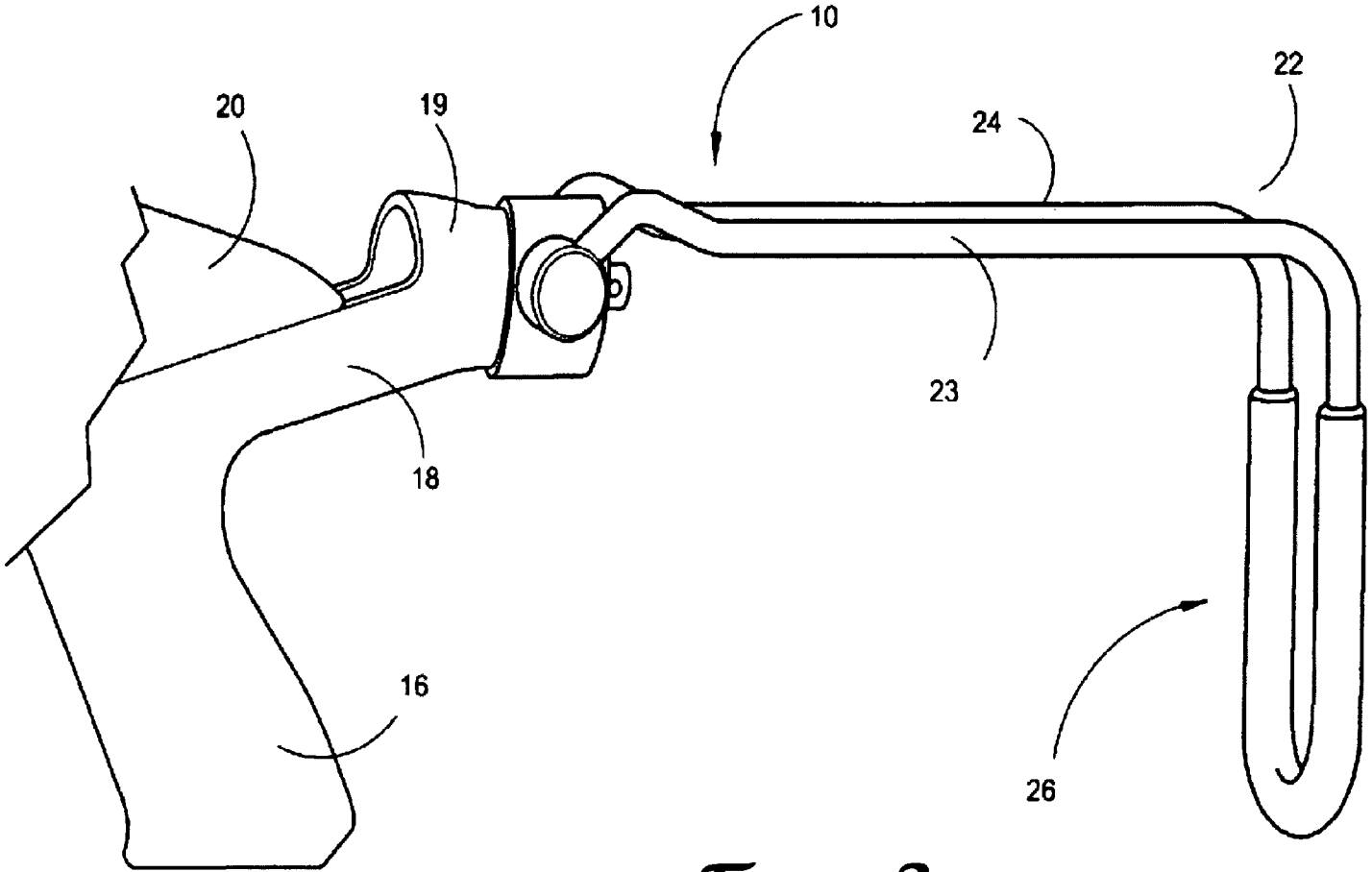
FIG. 3 shows a side perspective view illustrating the folding stock assembly secured to the rear end of the neck portion of a handgrip.

Turning now to the drawing Figs., FIGS. 1-3 show the folding stock assembly secured to the rear end of a firearm 12. The folding stock assembly is generally designated numeral 10. The firearm 12 has a gun barrel 14, a forend 15, and a handgrip 16. A neck portion extends rearwardly from the top end of a handgrip 16 and has a tubular member 19 formed at its rear end. A connecting member 20 secures the receiver of the firearm 12 to the top end of handgrip 16. In FIGS. 1 and 3, the folding stock assembly 10 is illustrated in its rearward, functional deployed position. In FIG. 2, the folding stock assembly 10 is illustrated in its static, forward stored position.

Elongated stock 22 has laterally spaced left elongated arm member 23 and right elongated arm member 24. A U-shaped shoulder rest portion 26 has its top end connected to the rear end of the respective right and left elongated arm members 23 and 24. In certain exemplary embodiments, elongated stock 22 comprises a continuous portion of material that extends from the left elongated arm member 23 to the right elongated arm member 24. Alternatively, elongated stock 22 may comprise a discrete left elongated arm member 23 and a discrete right elongated arm member 24, secured to one another via the shoulder rest portion 26.

Figure 4:
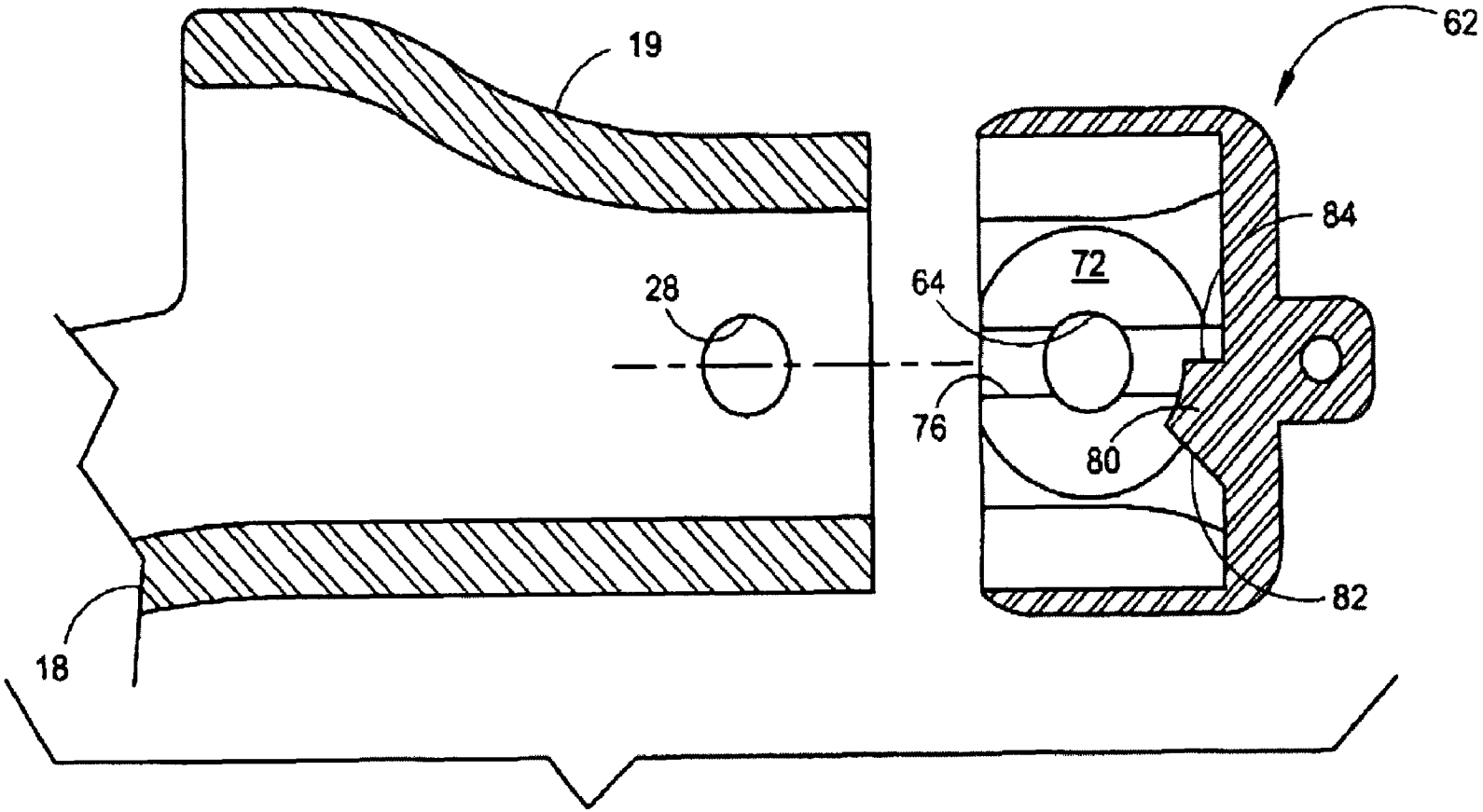
FIG. 4 shows an exploded cross sectional view of the neck portion and the end cap of a first exemplary embodiment of a folding stock assembly, according to this invention.
Figure 5:
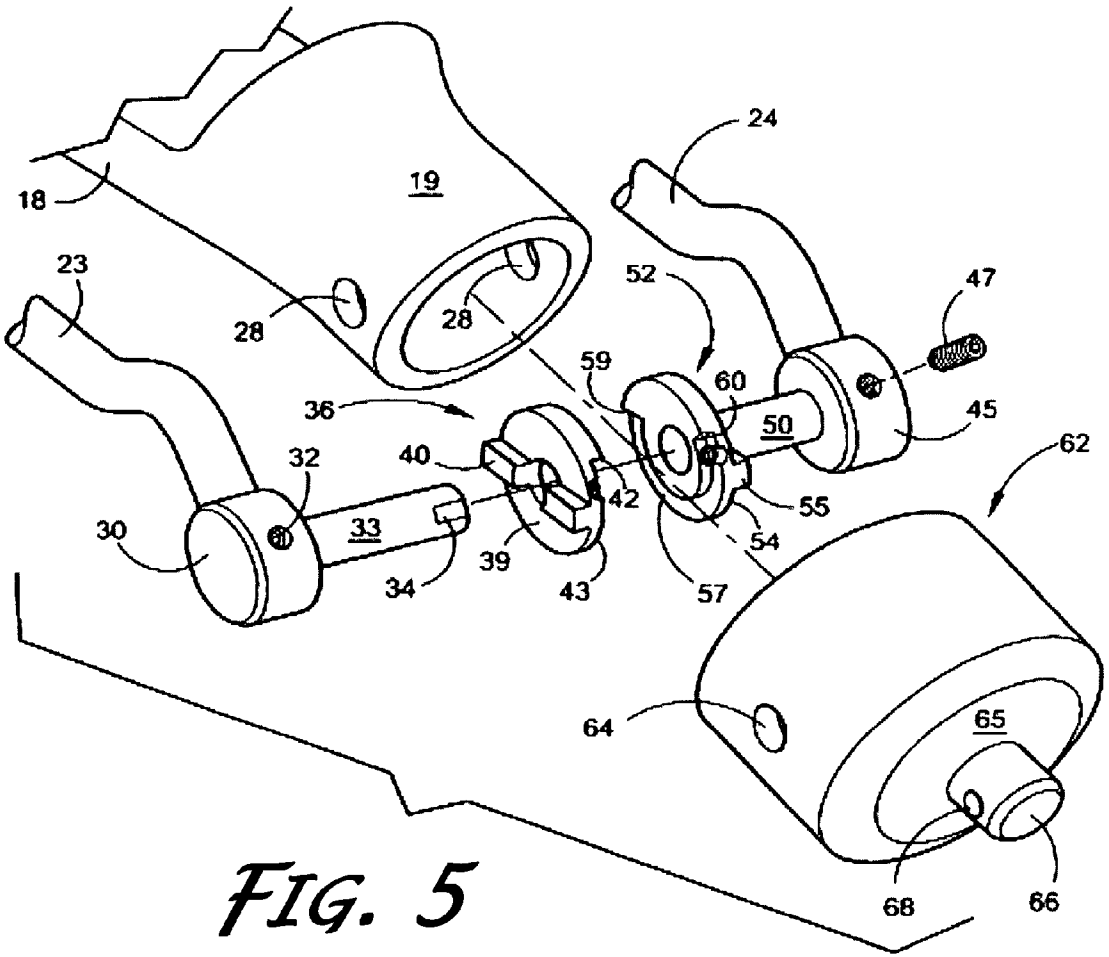
FIG. 5 shows an exploded view illustrating a first exemplary embodiment of a folding stock assembly secured to the front ends of the left and right elongated arm members of a stock, according to this invention.

FIGS. 4 and 5 illustrate the manner in which a first exemplary embodiment of the folding stock assembly is secured to the tubular portion 19 of the neck portion 18. Tubular portion 19 has a pair of diametrically opposed secondary apertures 28 formed therein. A left front end member 30 is secured to the front end of left elongated arm member by a set screw that is screwed into threaded bore hole 32. The left shaft member 33 extends inwardly from front end member 30 and it has a relieved surface 44 adjacent its front end. A left disc 36 is inserted on the inner end of left shaft member 33 and held securely thereto by set screw 38. The outer surface 39 of left disc 36 has a raised boss member 40 extending across most of its width. A raised shoulder 42 extends inwardly from the inner surface 43. A front end member 45 is secured to the front end of right elongated arm member 24 by a set screw 47 that threads into threaded bore hole 48. A right shaft member 50 extends inwardly from right front end member 45. Right disc 52 is secured on the inner end of right shaft 50. Right disc 52 has an outer surface 54 having a raised boss member 55 extending across most of its width. Right disc 52 has an inner surface 57 having a raised shoulder 58 thereon. Raised shoulder has a stop 59 and a stop 60 that mates with structure in the interior of end cap 62.

Figure 6:
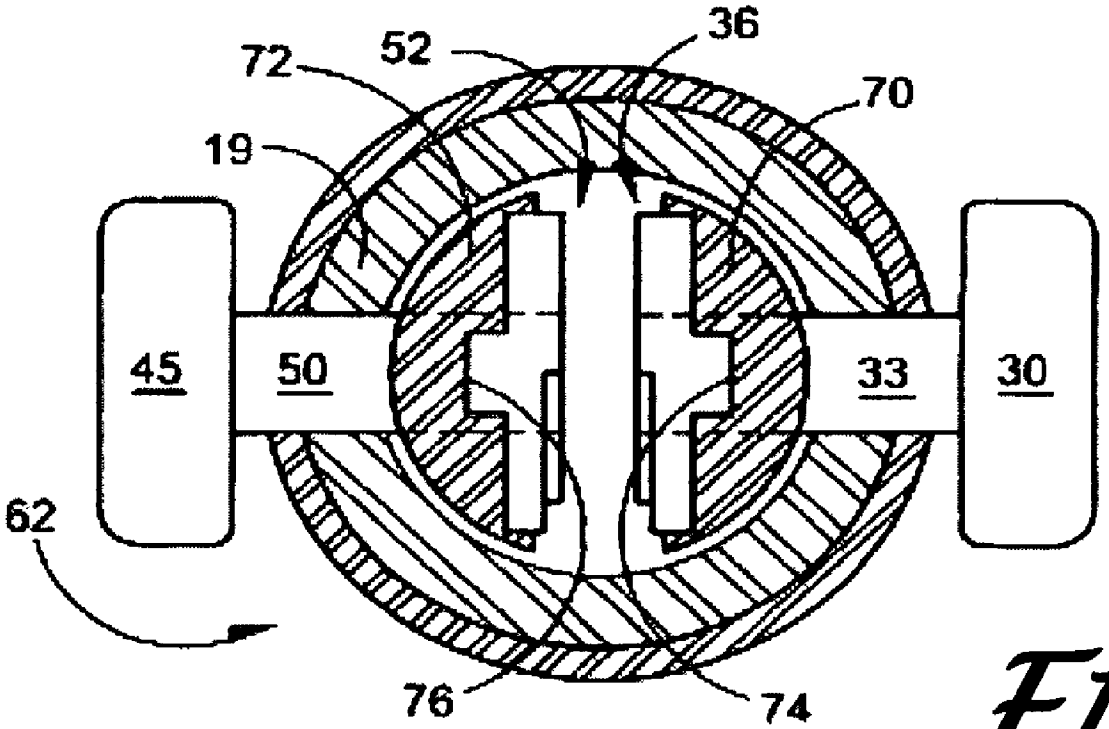
FIG. 6 shows a schematic cross section view of the end cap, the tubular member and the structure in the end cap that captures the left and right discs on the left and right shaft members.

The structure that illustrates how left disc 36 and right disc 52 are captured in end cap 62 is best illustrated in FIGS. 4 and 6. End cap 62 has diametrically opposed primary apertures 64, a rear wall 65, and a knob 66 having a sling attachment aperture. The interior of end cap 62 is cylindrical as is the interior of tubular member 19. A left receptacle 70 and a right receptacle 72 each have a cylindrical outer surface that mates with the cylindrical interior of tubular member 19. Left receptacle 70 has a groove 74 that matingly receives raised boss member 40 of left disc 36. Right receptacle 72 has a groove 76 that matingly receives raised boss member 55 of right disc 52. A centrally positioned dog member 80 extends rearwardly from the inner surface of rear wall 65 of end cap 62 in alignment with right disc 52 and left disc 36. Dog member 80 has rotation stops 82 and 84.

When left front end member 30 and right front end member 45 are squeezed together left disc 36 and right disc 52 travel inwardly. This causes raised boss member 40 and raised boss member 55 to disengage from the respective grooves 74 and 76 in receptacles 70 and 72. At this time, elongated stock 22 can be pivoted between its static forward stored position and its rearward functional deployed position. The rotation is limited by the stops on the respective shoulders on the inner surface of discs 52 and 36 when they contact the rotation stops 82 and 84 of dog member 80.

Figure 7:
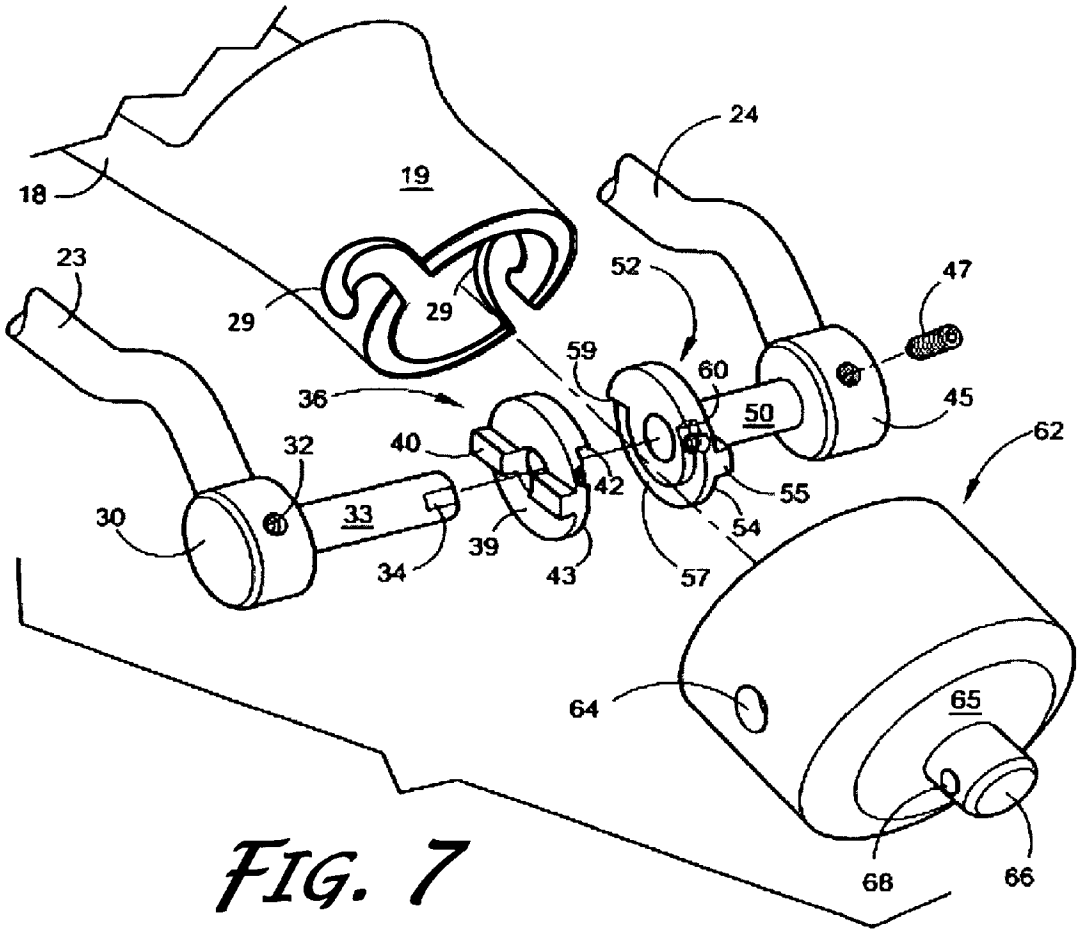
FIG. 7 shows an exploded view illustrating a second exemplary embodiment of a folding stock assembly secured to the front ends of the left and right elongated arm members of a stock, according to this invention.
Figure 8A:
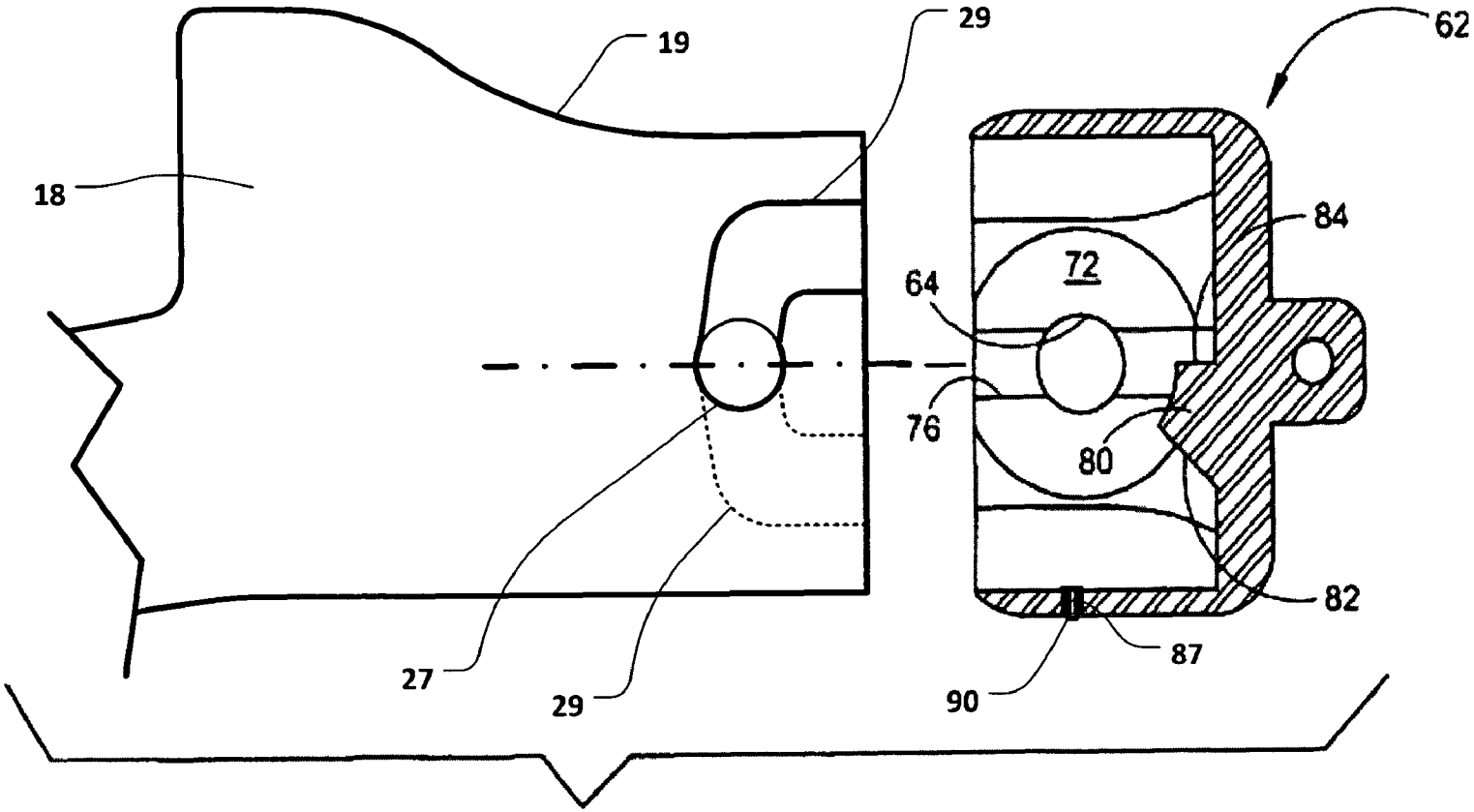
FIG. 8A shows a side view of the neck portion and the end cap of a second exemplary embodiment of a folding stock assembly, according to this invention.
Figure 8B:
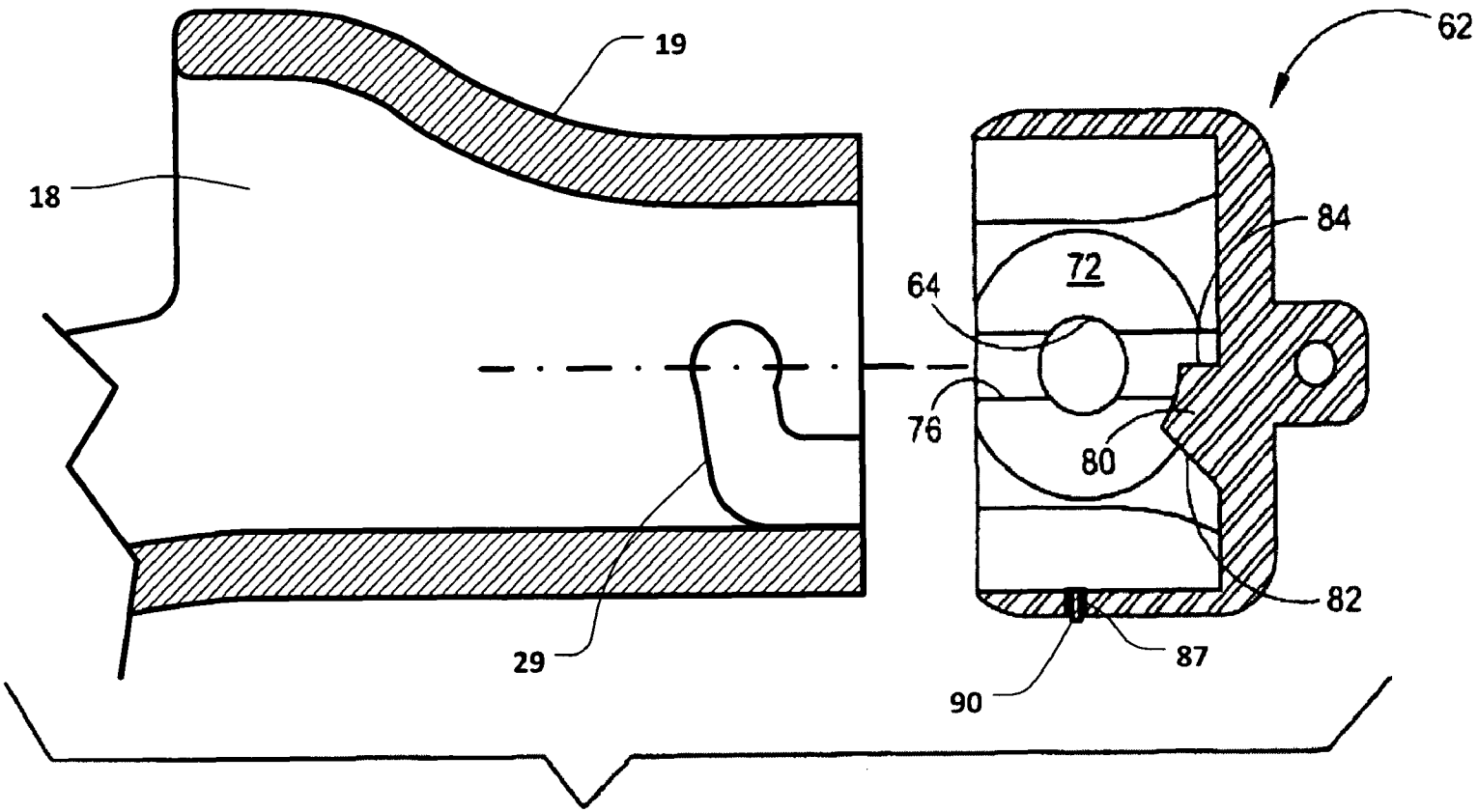
FIG. 8B shows an exploded cross sectional view of the neck portion and the end cap of a second exemplary embodiment of a folding stock assembly, according to this invention.

FIGS. 7-8B illustrate the manner in which a second exemplary embodiment of the folding stock assembly is secured to the tubular portion 19 of the neck portion 18. As illustrated in FIGS. 7-8B, the diametrically opposed secondary apertures 28, as shown in FIGS. 4 and 5, are replaced by diametrically opposed locking channels 29. The locking channels 29 are mirror images of one another and extend in a generally "L" shape from the terminating end of the tubular portion 19 of the neck portion 18 to a locking portion 27.

Each of the locking channels 29 is formed so as to accept one of the left shaft member 33 or the right shaft member 50, such that, in order to secure the folding stock assembly to the tubular portion 19 of the neck portion 18 the left shaft member 33 and the right shaft member 50 are each aligned with one of the locking channels 29. As the folding stock assembly is urged onto the tubular portion 19 of the neck portion 18, the left shaft member 33 and the right shaft member 50 move within the locking channels 29 such that the folding stock assembly is twisted until the left shaft member 33 and the right shaft member 50 are seated within the locking portions 27 of the locking channels 29.

The frictional fit of the left shaft member 33 and the right shaft member 50 within the locking portions 27 of the locking channels 29 may be sufficient to secure the folding stock assembly to the tubular portion 19 of the neck portion 18.

In certain exemplary embodiments, one or more textured areas, protrusions, or bumps may be formed in or along the locking channels 29 to provide additional frictional engagement between the left shaft member 33, the right shaft member 50, and the locking channels 29.

In certain exemplary embodiments, a set screw 90 is provided within an aperture 87 formed in the end cap 62. If the set screw 90 is provided, when the folding stock assembly is secured to the tubular portion 19 of the neck portion 18, the set screw 90 can be tightened to engage the surface of the tubular portion 19 of the neck portion 18 and further secure the folding stock assembly to the neck portion 18 by providing resistance to the rotation of the end cap 62 relative to the neck portion 18.

While this invention has been described in conjunction with the exemplary embodiment(s) outlined above, it is evident that this invention is not limited to particular variation(s) set forth and many alternatives, adaptations, modifications, and variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Such alternatives, adaptations, modifications, and variations should and are intended to be and are comprehended within the meaning and range of equivalents of the disclosed exemplary embodiment(s) and may be substituted without departing from the true spirit and scope of the invention. Accordingly, the foregoing description of the exemplary embodiments of the invention, as set forth above, are intended to be illustrative, not limiting and the fundamental design should not be considered to be necessarily so constrained. Various changes, modifications, and/or adaptations may be made without departing from the spirit and scope of this invention.

What is claimed is:

1. A folding stock assembly for a firearm, comprising;

an elongated stock having laterally spaced left and right elongated arm members each having a front end and a rear end;

said front end of said left elongated arm member having a left front end member secured thereto, said left front end member having a left shaft member extending inwardly therefrom, said left shaft having a front end having a left disc rigidly secured thereto, and said left disc having an outer surface and an inner surface;

said front end of said right elongated arm member having a right front end member secured thereto, said right front end member having a right shaft member extending inwardly therefrom, said right shaft member having a front end having a right disc rigidly secured thereto, and said right disc having an outer surface and an inner surface;

a vertically oriented shoulder rest portion having laterally spaced top ends that are connected to the respective rear ends of said respective left and right elongated arm members;

pivot means connected to said respective front ends of said elongated left and right arm members that allow said elongated stock to pivot from a static forward stored position to a functional deployed position;

a handgrip of a firearm having a neck portion extending rearwardly therefrom;

a tubular member having a rear end extending rearwardly from said neck portion, wherein a pair of diametrically opposed locking channels are formed in said tubular member adjacent said rear end, wherein each locking channel is formed so as to accept one of the left shaft member or the right shaft member.

2. The folding gunstock of claim 1, wherein said left and right elongated arm members and said shoulder rest portion are integrally formed.

3. The folding gunstock of claim 2, wherein said left and right elongated arm members and said shoulder rest portion are made of metal rod.

4. The folding gunstock of claim 1, in combination with a firearm having a handgrip connected to the rear end of the receiver of the firearm; said handgrip having a neck portion extending rearwardly from the top end of the handgrip.

5. The folding gunstock of claim 1, wherein said front end of said left elongated arm member has a left front end member secured thereto;

said left front end member having a left shaft member extending inwardly therefrom; said left shaft having a front end having a left disc rigidly secured thereto; said left disc having an outer surface and an inner surface;

said right front end member having a right shaft member extending inwardly therefrom; said right shaft member having a front end having a right disc rigidly secured thereto; said right disc having an outer surface and an inner surface.

6. The folding gunstock of claim 5, further comprising a handgrip of a firearm having a neck portion extending rearwardly therefrom; a tubular member having a rear end extends rearwardly from said neck portion; and a pair of diametrically opposed locking channels are formed in said tubular member adjacent said rear end.

7. The folding gunstock of claim 1, further comprising a tubular end cap open at its front end and having a rear wall closing said rear end; a pair of diametrically opposed primary horizontal apertures are formed in said cap that align with said diametrically opposed locking channels when said cap is telescoped over said rear end of said tubular member; said left shaft member and said right shaft member are inserted into their respective primary apertures and their respective locking channel.

8. The folding gunstock of claim 7, wherein said left and right front end members are disc-shaped.

9. The folding gunstock of claim 7, further comprising a knob extending rearwardly from said rear wall of said cap and there is a sling-attachment aperture extending transversely through said knob.

10. The folding gunstock of claim 7, further comprising a raised boss member on said outer surface of said left and right disc and they are removably interlocked with structure in said cap to releasably lock said elongated stock in either its static forward stored position or in its rearward functional deployed position.

11. The folding gunstock of claim 10, wherein said left and right disc have a raised shoulder on their inner surfaces having a pair of stops that limit the number of degrees of rotation of said left and right shaft members.

* * * * *